US010388266B2

(12) United States Patent
Schläpfer et al.

(10) Patent No.: US 10,388,266 B2
(45) Date of Patent: Aug. 20, 2019

(54) PLANAR ELEMENT FOR THE ACTIVE COMPENSATION OF NOISE IN AN INTERIOR ROOM AND ANTI-NOISE MODULE THEREFOR

(71) Applicant: OASWISS AG, Zürich (CH)

(72) Inventors: Reto Schläpfer, Pfaffhausen (CH); Markus Pinkpank, Zürich (CH)

(73) Assignee: OASWISS AG (CH)

( * ) Notice: Subject to any disclaimer, the term of this patent is extended or adjusted under 35 U.S.C. 154(b) by 0 days.

(21) Appl. No.: 16/310,581

(22) PCT Filed: Jun. 14, 2017

(86) PCT No.: PCT/EP2017/064593

§ 371 (c)(1),
(2) Date: Dec. 17, 2018

(87) PCT Pub. No.: WO2017/216250

PCT Pub. Date: Dec. 21, 2017

(65) Prior Publication Data

US 2019/0147846 A1 May 16, 2019

(30) Foreign Application Priority Data

Jun. 17, 2016 (DE) ..... 10 2016 007 391

(51) Int. Cl.
*G10K 11/178* (2006.01)
*E04B 1/82* (2006.01)
*E04B 9/00* (2006.01)

(52) U.S. Cl.
CPC ..... *G10K 11/17853* (2018.01); *E04B 1/8209* (2013.01); *E04B 9/001* (2013.01);
(Continued)

(58) Field of Classification Search
CPC ..... G10K 11/17853; G10K 11/1787; G10K 11/17873; G10K 11/178; G10K 2210/12;
(Continued)

(56) References Cited

U.S. PATENT DOCUMENTS 5,315,661 A * 5/1994 Gossman ..... G10K 11/178 381/71.1
6,959,092 B1 * 10/2005 Berkhoff ..... G10K 11/178 381/71.1

(Continued)

FOREIGN PATENT DOCUMENTS

CN 205144265 U 4/2016
DE 2139941 A1 3/1973

(Continued)

OTHER PUBLICATIONS

International Search Report; PCT Application No. PCT/EP2017/064593; dated Dec. 21, 2017.

(Continued)

*Primary Examiner* — William A Jerez Lora
(74) *Attorney, Agent, or Firm* — Polsinelli PC

(57) ABSTRACT

A planar element is provided for the active compensation of noise from different directions in an interior room. The planar element is equipped with anti-noise modules, each having a microphone and an electronic circuit having a combination of filters for adjusting phase and amplitude and an electronically controllable amplifier and a loudspeaker for active noise cancellation. The planar element is equipped over the width thereof with a plurality of anti-noise modules on each of a plurality of different longitudinally extending lines and is to be placed, for example, in front of a window having bounding walls. The anti-noise modules can be inconspicuously integrated into the planar element and jointly form longitudinally extending chains of anti-noise modules. The loudspeakers emit a canceling sound with respect to the noise, which canceling sound first passes through the planar element and subsequently largely cancels the noise.

15 Claims, 10 Drawing Sheets

Figure 1:
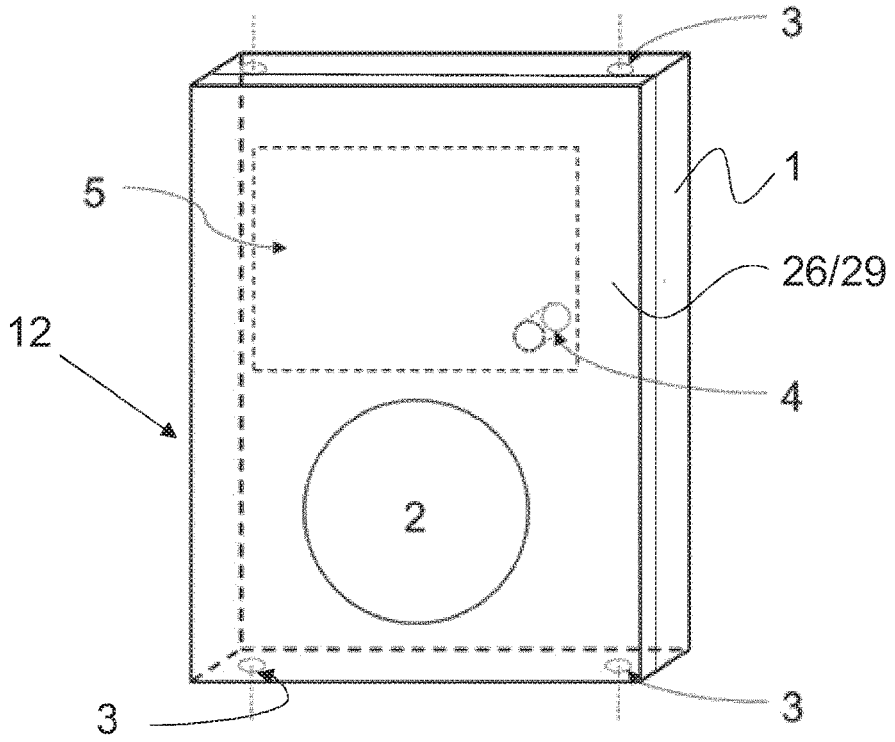

(52) U.S. Cl.
CPC ..... *G10K 11/178* (2013.01); *G10K 11/1787* (2018.01); *G10K 11/17873* (2018.01); *G10K 2210/12* (2013.01); *G10K 2210/3027* (2013.01); *G10K 2210/3215* (2013.01); *G10K 2210/3216* (2013.01)

(58) Field of Classification Search
CPC ... G10K 2210/3027; G10K 2210/3215; G10K 2210/3216; E04B 1/8209; E04B 9/001
USPC ..... 381/71.1, 71.8
See application file for complete search history.

(56) References Cited

U.S. PATENT DOCUMENTS

| | | | | |
|---|---|---|---|---|
| 7,854,295 | B2 * | 12/2010 | Kakuhari | G10K 11/178 181/206 |
| 8,453,788 | B2 * | 6/2013 | Huettner | G10K 11/172 181/196 |
| 2012/0155669 | A1 * | 6/2012 | Carme | G10K 11/178 381/71.12 |
| 2013/0016847 | A1 * | 1/2013 | Steiner | E04B 1/8209 381/73.1 |
| 2016/0330546 | A1 * | 11/2016 | Barrentine | H04R 3/04 |
| 2018/0233123 | A1 * | 8/2018 | Jin | H04R 3/02 |

FOREIGN PATENT DOCUMENTS

| | | | |
|---|---|---|---|
| WO | 01037256 | A1 | 5/2001 |
| WO | 02095725 | A1 | 11/2002 |
| WO | 20170216250 | A1 | 12/2017 |

OTHER PUBLICATIONS

English Translation of International Search Report; PCT Application No. PCT/EP2017/064593; dated Dec. 21, 2017.
Written Opinion of PCT Application No. PCT/EP2017/064593; dated Dec. 21, 2017.
English Description of DE2139941; Retreived From www.espacenet.com on Dec. 10, 2018.
English Language Abstract of CN205144265; Retreived From www.espacenet.com on Dec. 10, 2018.

* cited by examiner

PLANAR ELEMENT FOR THE ACTIVE COMPENSATION OF NOISE IN AN INTERIOR ROOM AND ANTI-NOISE MODULE THEREFOR

CROSS-REFERENCE TO RELATED APPLICATIONS

This application is a national stage entry of PCT/EP2017/064593 filed Jun. 14, 2017, which claims priority to German patent application 10 2016 007 391.8 filed on Jun. 17, 2016, the contents of each are hereby incorporated by reference in their entirety.

This disclosure concerns a planar element for the active compensation of background noise in an interior, whereby this planar element can be designed as a curtain for a window, as a standing wall, a partition wall, as a partition wall or as a ceiling part. In order to compensate for the background noise, anti-noise is being generated, i.e. a targeted and artificially generated sound that is superimposed on the background noise and whose phase is shifted relative to the background noise in such a way that the background noise is extinguished or greatly attenuated. Ideally, the phase difference of the anti-noise is 180 degrees and its volume or amplitude also corresponds to that of the background noise, so that the latter is then theoretically extinguished to 100%. The terms Active Noise Reduction [ANR] or Active Noise Cancellation [ANC] are commonly used for this purpose. The anti-noise module associated with this planar element is also the subject of the disclosure.

"Sound reduction devices" or "active noise cancellation devices" are known in various versions, including those that work with an analog circuit. It is essentially a matter of generating a counter-wave with the same frequency, intensity or sound pressure, but with a phase shifted by 180 degrees. Such well-known anti-sound arrangements, with the exception of the well-known headphones, are characterized by a greater or lesser degree of complexity and often require considerable constructive measures and/or complex signal processing in order to unfold their full effect.

Such known anti-sound arrangements can in principle be divided into three groups: anti-sound headphones, anti-sound arrangements for outdoor use and anti-sound arrangements for indoor use. The latter include arrangements for vehicles where noise generated by the vehicle itself is usually to be suppressed, e.g. in aircraft or cars. On the other hand, there are arrangements for interiors in which on the one hand noise generated in the room itself is to be reduced, e.g. in offices, or on the other hand noise penetrating from outside through windows and doors, such as street noise in living rooms, work rooms and offices is to be reduced.

US 2011/0274283 A1 describes noise reduction systems for a wide variety of applications and also mentions analog circuits (page 1, right column, 8th line). The arrangement of a series of sound elimination units is also mentioned and shown (page 1, right column, line 7 from below). A single sound elimination unit consists of a directional microphone, a directional loudspeaker and a signal processing module (page 2, left column, lines 2-3). Such modules can be arranged in a one-, two- or three-dimensional pattern or grid (page 2, left column, section [0012], lines 5-6). The sound cancellation is mathematically described by the formula before section [0037]. And in section [0037] the variables are defined. A Panasonic unidirectional microphone, for example, is suitable, it says (page 5, section [0045]). The loudspeaker is essentially positioned behind the microphone (section 45, lines 13-16), and the arrangement can also be very small. A model from Tang Band Comp. see section [0049]—is suitable as a loudspeaker driver. Section [0055] states that below the resonance frequency of the system, a sound reduction of 15 dB can be achieved (starting at line 6). In section [0068], starting with the sixth line, the necessary electronics are described, including an analog one. Specific applications with, for example, a series of modules or with other arrangements of the modules are described in section [0077] to [0084].

Figure 5:
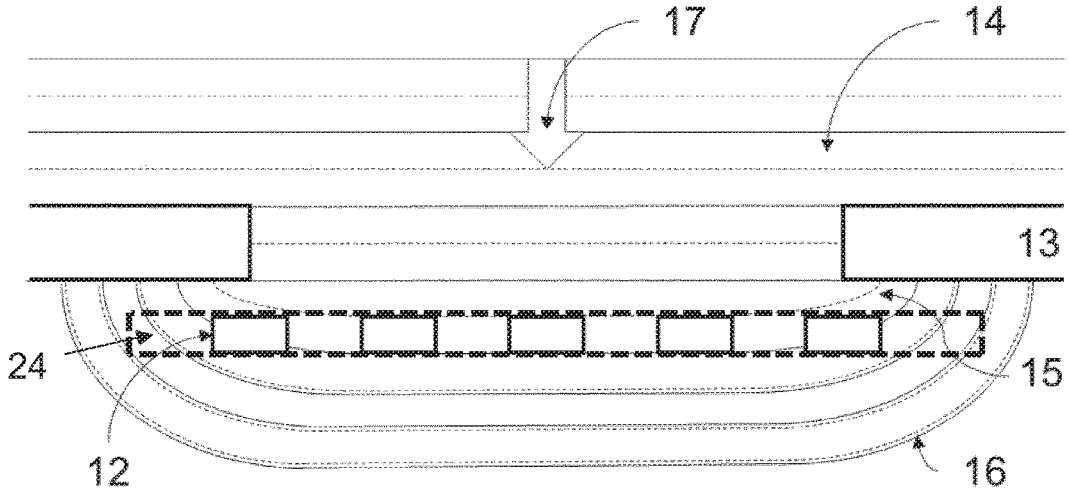

U.S. Pat. No. 4,025,724 is from the 70s and describes sound cancellation units. FIG. 5 shows a matrix-shaped arrangement of such units. In column 2 from the first line it states that a pattern or series of sound elimination units are arranged near a surface and each generate an output signal that is dependent on the acoustic sound generated in the immediate environment of the surface. Column 2, line 29 states that a signal generating circuit is basically used which phase-shifts the signals by 180° and then sends them to a loudspeaker. The system is described in column 3, starting at line 59 to column 4 line 10. In column 4, line 30, it is stated that more than one module can be installed, i.e. an array, for example. And in line 46 it says: The microphones are arranged in a symmetrical array, here around the loudspeaker. In column 7, line 34 states: "The horizontal and vertical distance between adjacent sound elimination modules is in the range of approx. 1.56 feet (=approx. 47 cm) or less.

US 2012/0155669 A1 discloses a noise reduction unit as shown in FIG. 8a in a combination of passive and active noise abatement—as can be seen in section [0028]. A stack of beams is used, each beam containing a series of noise elimination units with micros 62 and loudspeakers 61, and a number of such beams are arranged in parallel. Inside the beams there is noise absorbing material. The unit can be placed in the window when open, to largely eliminate the external noise as outlined in [0032] and [0037].

US patent application US2007/0223714 A1 primarily concerns anti-noise measures in open space. Both the diffracted noise at the upper edge of a sound-insulating wall and the direct noise, i.e. the noise directly affecting the receiver, are considered. To this end, noise collection microphones are located close to the source of the noise, and noise correction microphones are located close to the receiver, i.e. in the area to be protected from sound. The examples of anti-noise barriers and their descriptions shown in FIGS. 7 to 11 of this patent application are not quite clear, but it is obvious that such noise collection microphones are located close to or directed towards the source of the noise, while noise correction microphones are provided in the sound protected area. It is noticeable that, according to this document, the anti-noise loudspeakers are apparently arranged perpendicular to the sound input direction, which is probably a less effective arrangement due to the radiation characteristics of loudspeakers but also due to their distance. In addition, the entire arrangement, i.e. all microphones and loudspeakers, are connected via an extensive network and are thus controlled and permanently installed.

US patent application US2006/0285697 A1 by M. Nishikawa et al. shows a further series of very different examples or executions. However, these refer in principle to anti-sound measures in free space, whereby only the diffracted sound is to be influenced or extinguished. In some figures, especially in FIGS. 33 to 36, a kind of an anti-sound wall is indicated. However, these designs also refer only to background noise that is bent at the upper edge of a massive sound insulation wall. This "bent sound" is to be minimized by appropriate anti-sound. Two groups of several microphones serve this purpose, one group on the upper edge of the sound barrier to collect the noise, and another group for error correction in the sound protected area, i.e. close to the receiver and close to several loudspeakers. The whole thing is in turn connected via a rather complex and permanently installed network of transmitters, receivers and processing units. An analog network is shown in FIG. 31, a digital one in FIG. 32 of this document.

The Japanese patent JP 4 742 064 B2, published as JP2008/241899 A, shows a curtain of striped flat-panel loudspeakers driven by a common control unit. The latter receives signals from a wireless microphone. The sound picked up by this one central microphone is to be actively compensated. This patent obviously shows no solution for noise or sound entering an interior from outside. Only the interior noise is compensated at a single microphone at the user's location, so that a sound protected area is only generated locally.

Xu's U.S. Pat. No. 9,230,534 B2 essentially concerns an arrangement with a directional microphone on the outside and inside and a HiFi-loudspeaker system on the inside, with the emphasis on signal processing of the microphones and the determination of a suitable anti-noise level. After all, an "outdoor/indoor" solution for the treatment of noise from outside that penetrates into an interior is shown here. Again, a network with an external microphone and a rather complex control system is being used.

Another example of an "outdoor/indoor" solution can be found in the form of an anti-sound device shown a few years ago under the trade name "Sono". This device, about the size of a hand, is to be attached to window panes and it is to perceive the vibrations of the outer pane and generate a signal of the same size on the inner pane. Apparently, the inner pane itself should serve as a membrane for sound generation. Experiments have shown that a reduction of the background noise by 12 db can be achieved. Furthermore, the Sono device should be able to produce a desired pleasant noise, which is of course not an anti-noise, but a covering or masking of the background noise. However, the device is currently not available on the market. The basic structure of the device is published on the Internet and can be found here: http://www.technikjournal.de/cms/front_content.php?idcat=59&idart=823. Whether the functions and services described are actually achieved, however, is not verifiable due to a lack of availability.

Overall, the findings show that electronic components for reducing or even eliminating sound—including analog devices—such as microphones, electronics and loudspeakers are known. The arrangement of such units in rows or in matrix form is also known.

The above mentioned examples give many hints, but they show some more theoretical than effectively practicable anti-sound solutions. The above mentioned solutions have hardly been used, if at all, commercially. They are also quite complicated and—with the exception of the functionally unknown Sono device—difficult to install and relatively difficult to adapt to the respective noise situation. All in all, these solutions are far away from an anti-noise solution that not only has a particularly 0, but can also be retrofitted and installed without profound expert knowledge, and which is nevertheless capable of impressively effectively reducing or almost eliminating background noise.

In view of this initial situation, the task of the present disclosure is to create a planar element for active compensation of background noise in an interior, whereby this planar element can be designed as a curtain for a window, as a standing wall, as a partition wall or as a ceiling part. To compensate for the background noise, anti-noise is to be generated, i.e. a targeted and artificially generated sound that is superimposed on the background noise and whose phase is shifted in relation to the background noise in such a way that the background noise is extinguished or greatly reduced. This planar element should be particularly inexpensive to produce and thus create an inexpensive anti-noise device for interiors, which is easily adaptable to different locations and their special conditions and therefore suitable for almost any interior. An essential requirement for this planar element is that it should offer the possibility of an uncomplicated, in particular subsequent installation by non-specialists, especially in the case of a curtain as well as a partition wall. A further task of the disclosure consists in the creation of a suitable anti-sound module for installation in such a planar element. The anti-noise solution in the form of this planar element should therefore have a particularly simple, extremely compact and light construction that can be manufactured very cost-effectively, can also be installed retrospectively and without profound expert knowledge by laypersons, and nevertheless be able to reduce or even eliminate disturbing noise impressively effectively.

The solution to this problem consists in a planar element, designed as a curtain for a window, as a standing wall, as a partition wall, as a ceiling part or wall part for active compensation of background noise in an interior, with a plurality of interconnected, similar anti-noise modules with a microphone, an electronic circuit having a combination of filters for matching phase and amplitude and an electronically controllable amplifier and a loudspeaker, which is characterized in that the planar element has over its width on a plurality of different lines a plurality of analogue controllable anti-sound modules each of which is at most 75 mm thick, at most 200 mm long and at most 200 mm wide, with a maximum weight of 300 grams per anti-sonic module, so that they are integrated inconspicuously into the planar element and together form a chain of anti-sonic modules extending along each of these lines, which are arranged one after the other via electrical supply wires connecting them together in the form of two electrical cables each extending along this line, the chain and its supply wires being connected in parallel and being supplied by two electrical supply wires or supply rails with a low-voltage power which transverse the longitudinal lines of the chains. The solution also consists of an anti-noise module in accordance with patent claim 13.

In short, this planar element as an anti-noise arrangement consists of a plurality of similarly structured, independent, to a certain extent self-sufficient anti-noise modules contained in it—in contrast to a known complex network. These anti-noise modules are compact and—in contrast to distributed components, which have been practiced up to now—contain all the necessary components for generating the required anti-noise, i.e. at least one microphone, one electrical circuit and one loudspeaker each. Only an external connection may be required for the power supply and external volume control, unless a battery, rechargeable battery or solar solution and/or a fixed volume setting is chosen. These anti-noise modules can be combined, assembled and optimized in a two-dimensional arrangement, for example. This allows an arrangement that can largely be adapted to the shape of a disturbance sound entry point, for example as an inverted U-shape that compensates for the disturbance sound entering through a tilted window. Any "correction microphones" with appropriate electrical networking are unnecessary. The adjustment to the given noise conditions is made simply by selecting, arranging and adjusting the volume or by the amplifier effect of the individual anti-noise modules. This allows the desired noise compensation to be set during installation by simple trial and error and can also be improved at any time with little effort in the event of any change in the noise conditions. Due to the possible invisible integration of the anti-noise modules in other functional furnishings, which can be designed as planar elements, for example in a lamella curtain, the living atmosphere and ambiance of the interior remains visually undisturbed, in contrast to equipment which, for example, is sticked or glued to the window.

The present disclosure therefore shows a solution that primarily addresses the last problem described, namely the reduction or elimination of unwanted external noise and mostly stationary internal noise in interiors, and it offers, so to speak, a pure indoor solution that is not only simple in its construction, but can also be installed retrospectively and without great expertise. The following facts illustrate the outstanding features and advantages of such a planar element according to the disclosure:

1. Ultra-flat, lightweight and compact design of the anti-noise module units, so that they can be elegantly integrated into a curtain—hardly visible.
2. Special power supply in parallel for entire rows of units or anti-sound modules, elegantly designed, with minimum effort, and also hardly visible.
3. The construction of the units is particularly cost-effective, with simple analog circuitry and efficient effect.
4. Thanks to the modular construction and the simple assembly, any and uncomplicated adaptation to the size and geometry of the sound entry is possible (e.g. window open or completely open).
5. Can be easily installed by laypersons with simple instructions.
6. The matrix with distances of approx. 15 cm between the units is particularly effective over a wide frequency band and achieves maximum sound reduction in the frequency range from 500 Hz to 1200 Hz, and at 703.2 Hz even optimum sound reduction of up to 20 dB.
7. The anti-noise modules are embedded in polyester felt, each with a rubber cap—and glued assembly of the units is particularly simple, weight-saving, quick and cost-effective to use.

Due to the design with autonomous anti-noise modules, no further signal processing is necessary, e.g. to compensate for noise from different directions. This also allows the production of low-cost variants, e.g. optimized for the size of the sound entry area. For example, different module arrangements can be developed for mounting on a window, depending on whether the window can or should only be tilted, opened or fully opened. In order to compensate for background noise generated in the room, e.g. in an open-plan office with noisy machines or in a noisy meeting area, the autonomous anti-noise modules can be integrated into movable or fixed partitions or curtains as planar elements. It is also possible to integrate anti-noise modules into planar elements that are designed as ceiling or wall constructions to compensate for background noise from a floor above or from an adjoining room.

Figure 2:
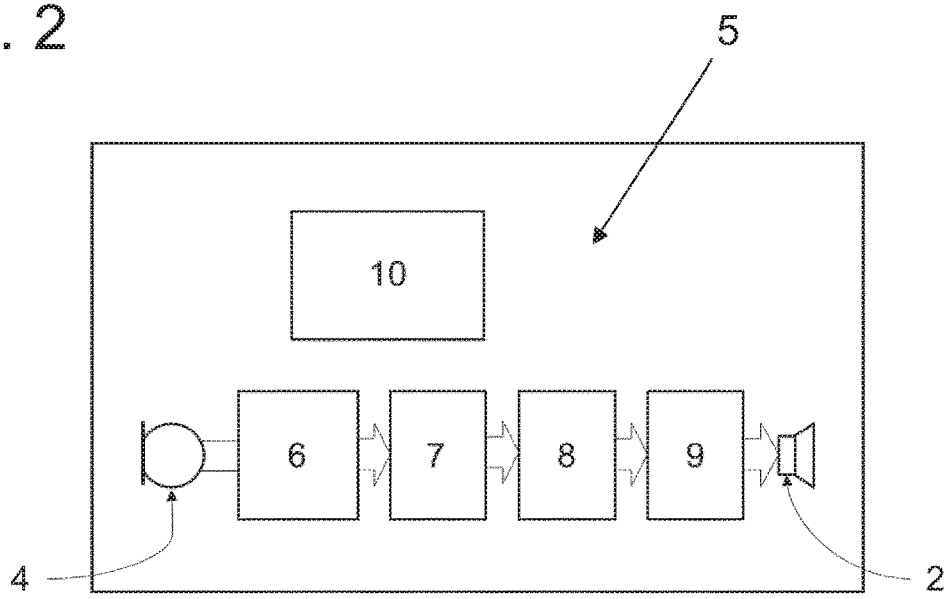
Figure 3:
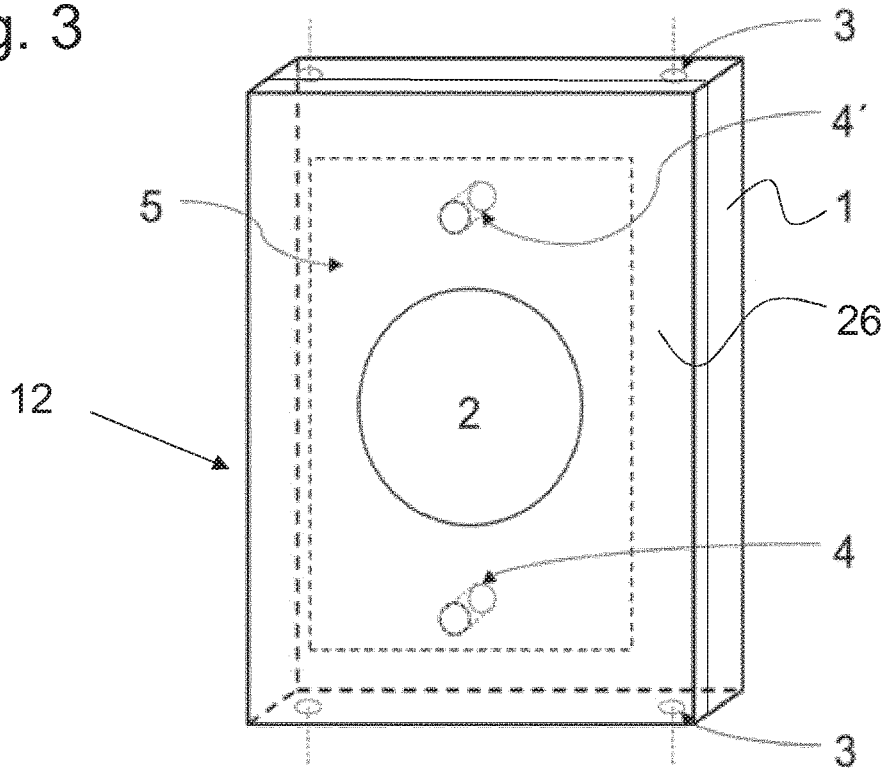
Figure 4:
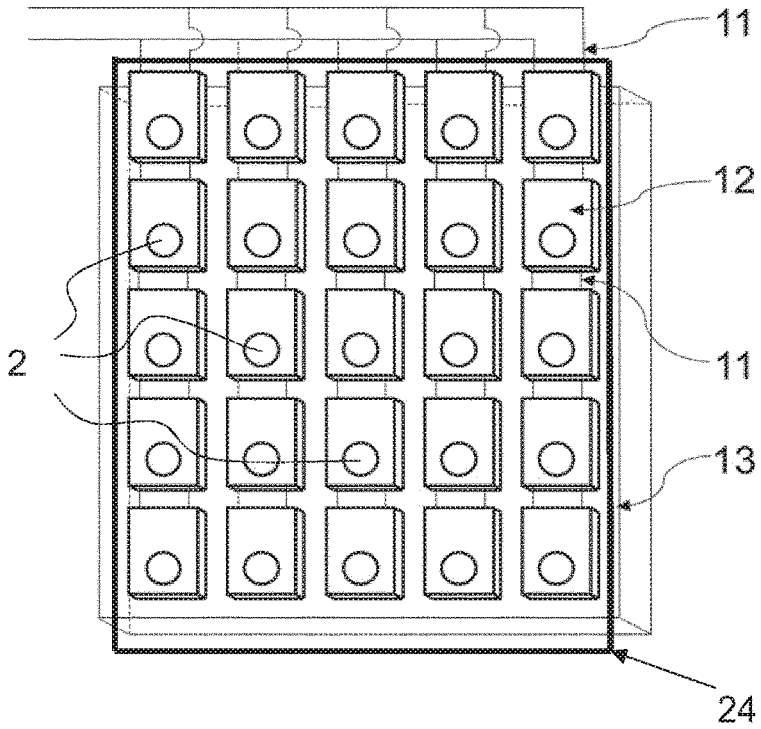
Figure 6:
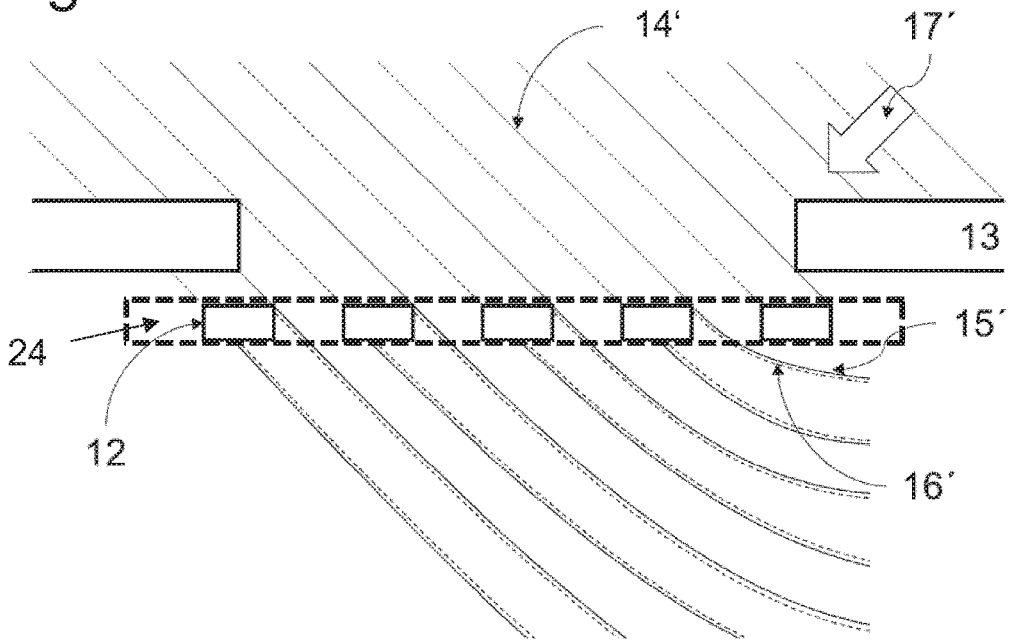
Figure 7:
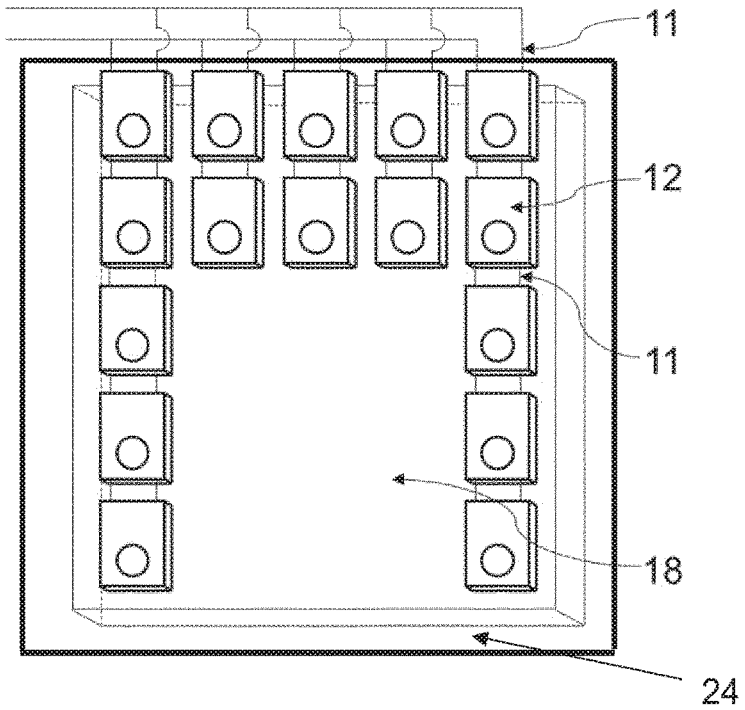
Figure 8:
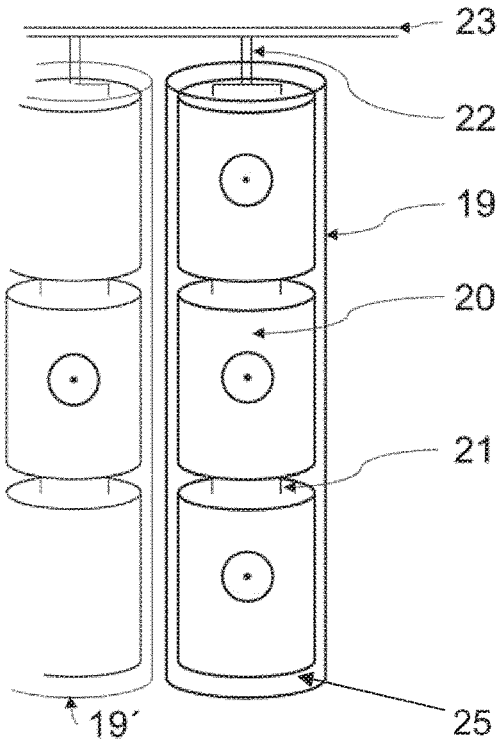
Figure 9:
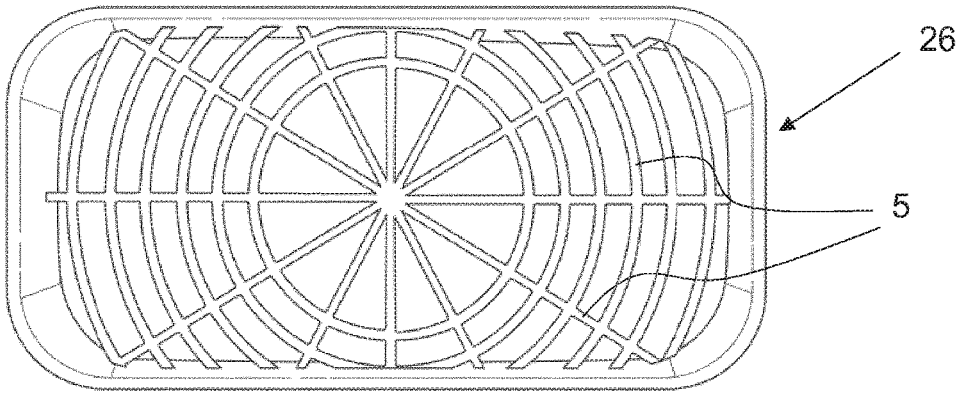
Figure 10:
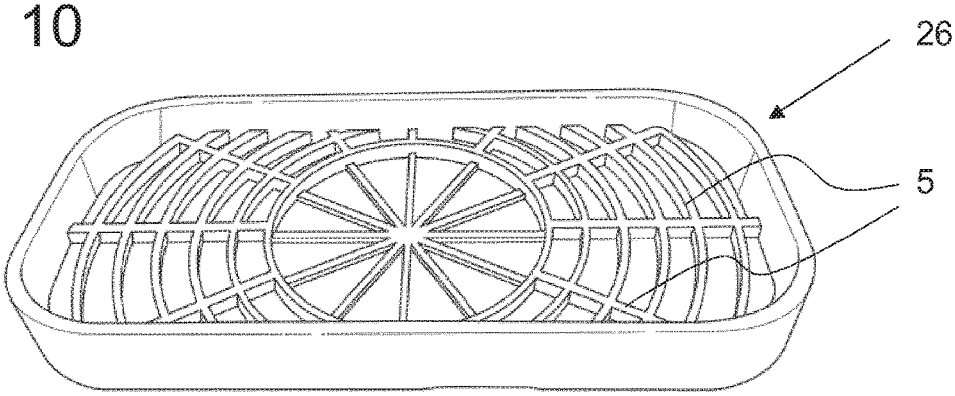
Figure 11:
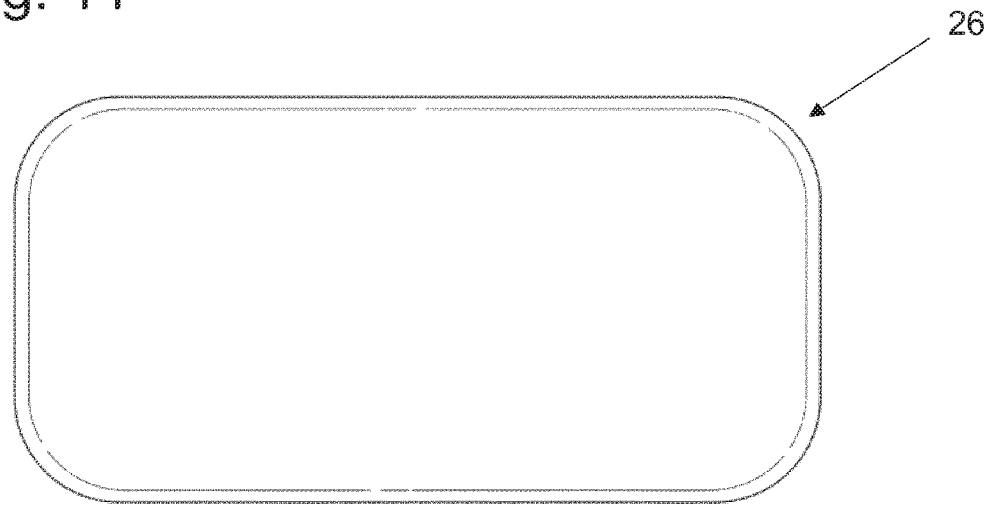
Figure 12:
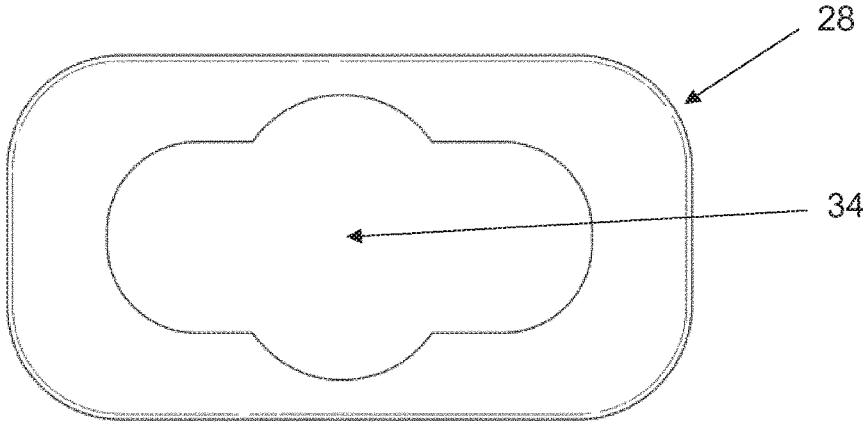
Figure 13:
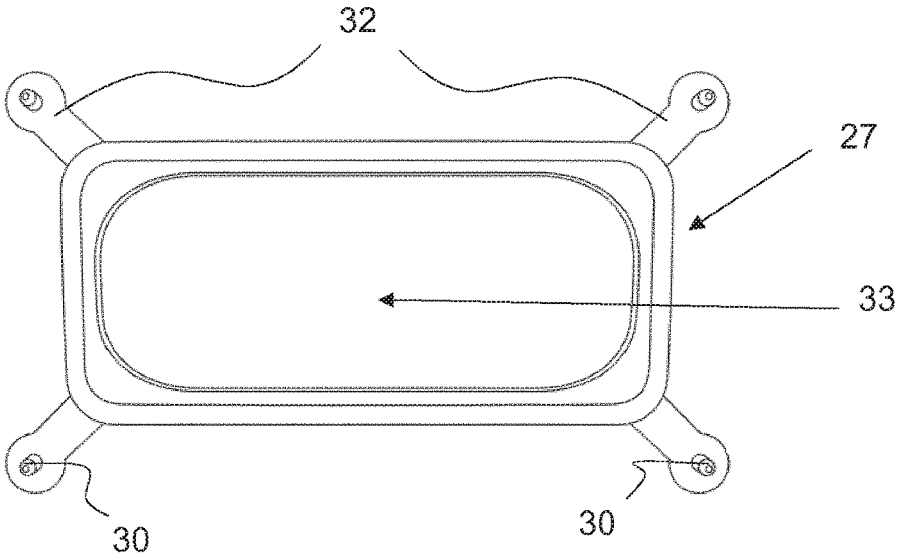
Figure 14:
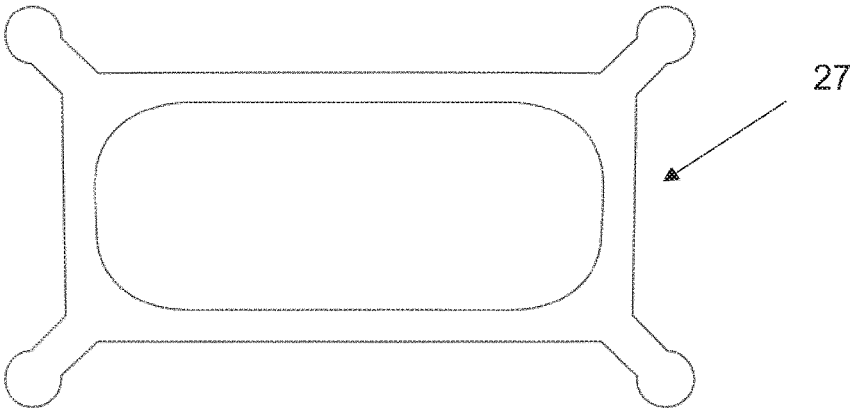
Figure 15:
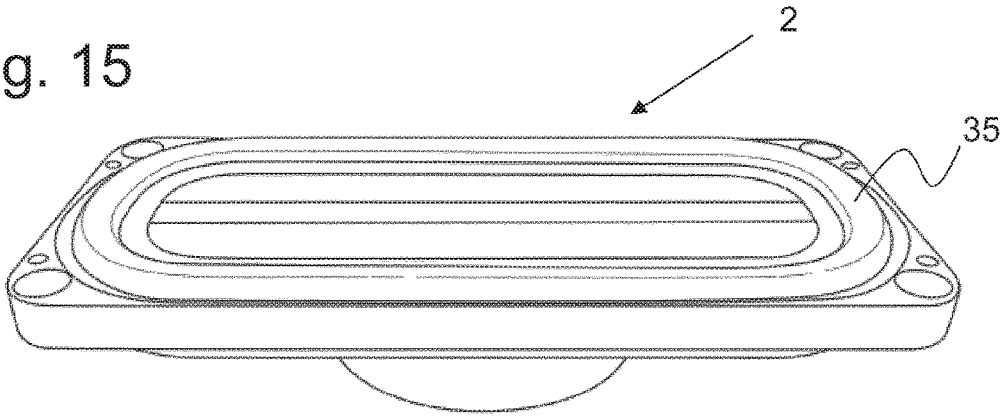
Figure 16:
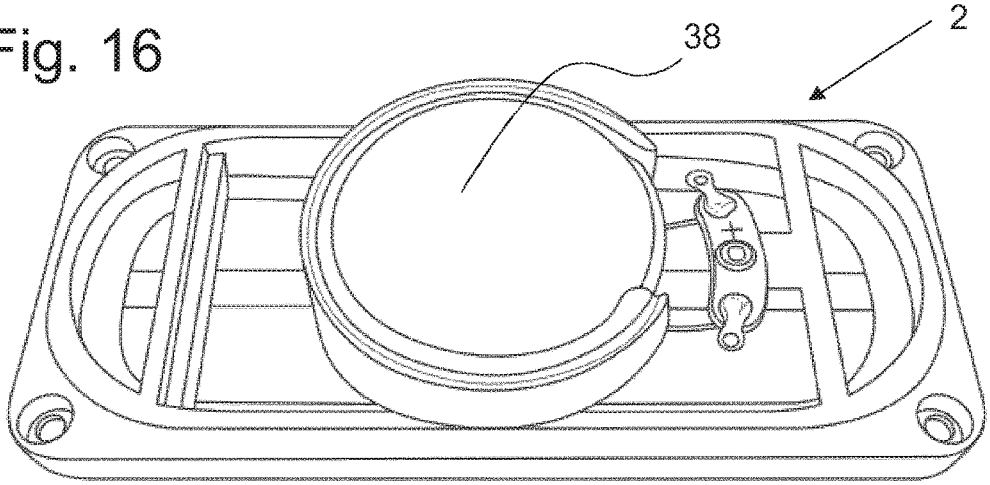
Figure 17:
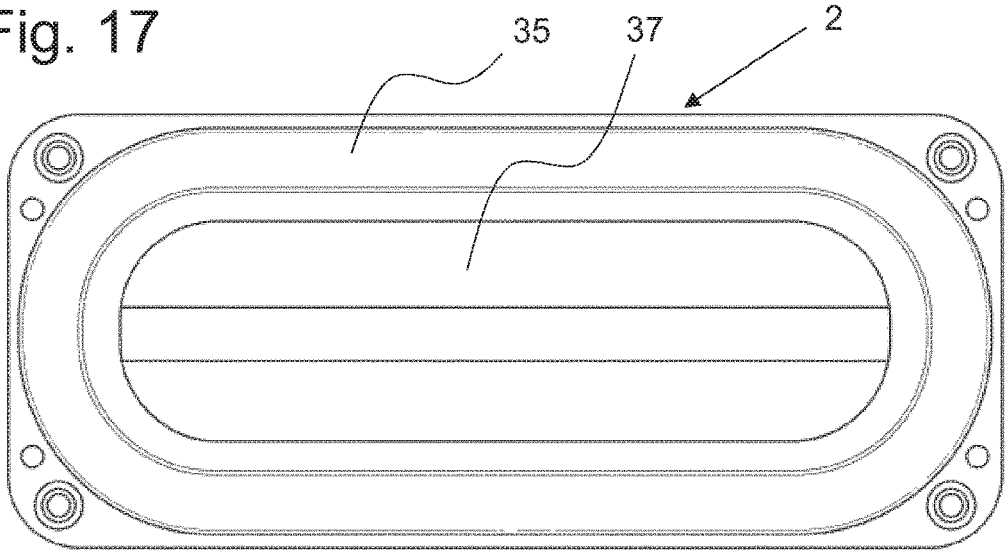
Figure 18:
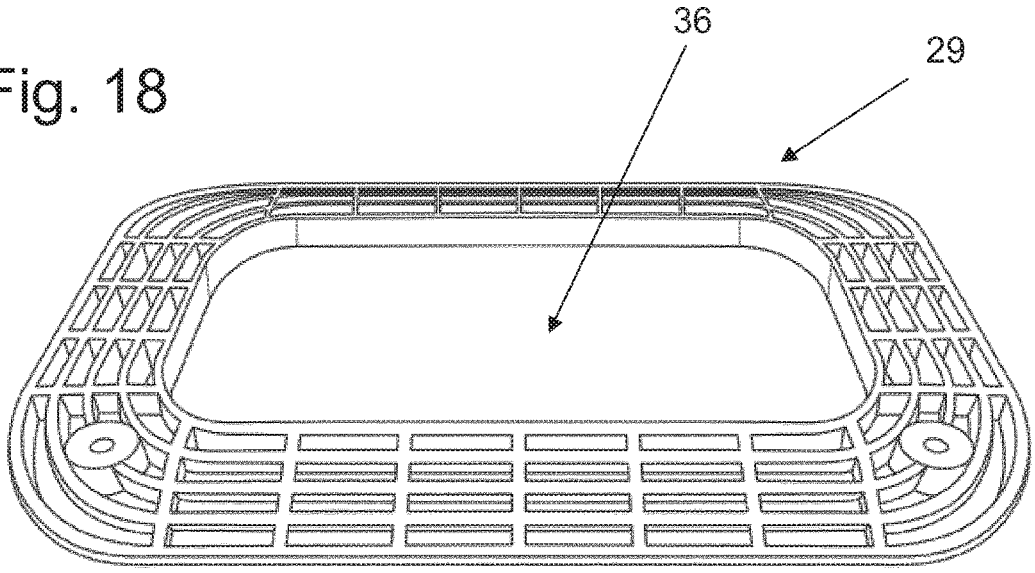
Figure 19:
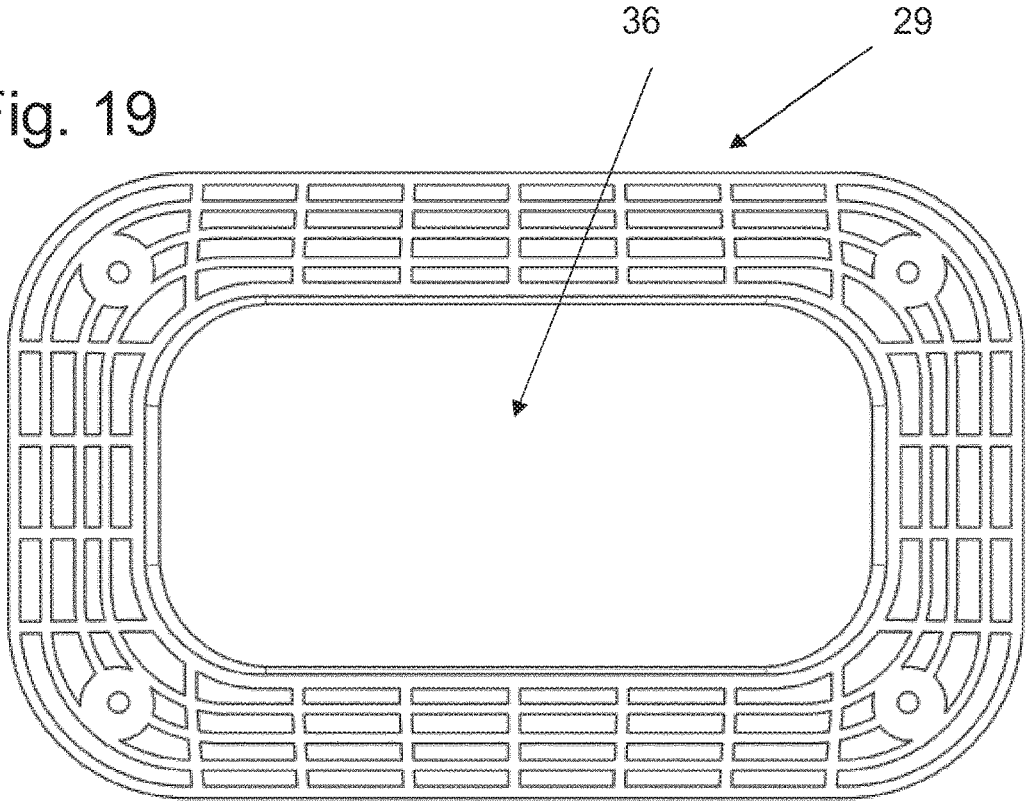
Figure 20:
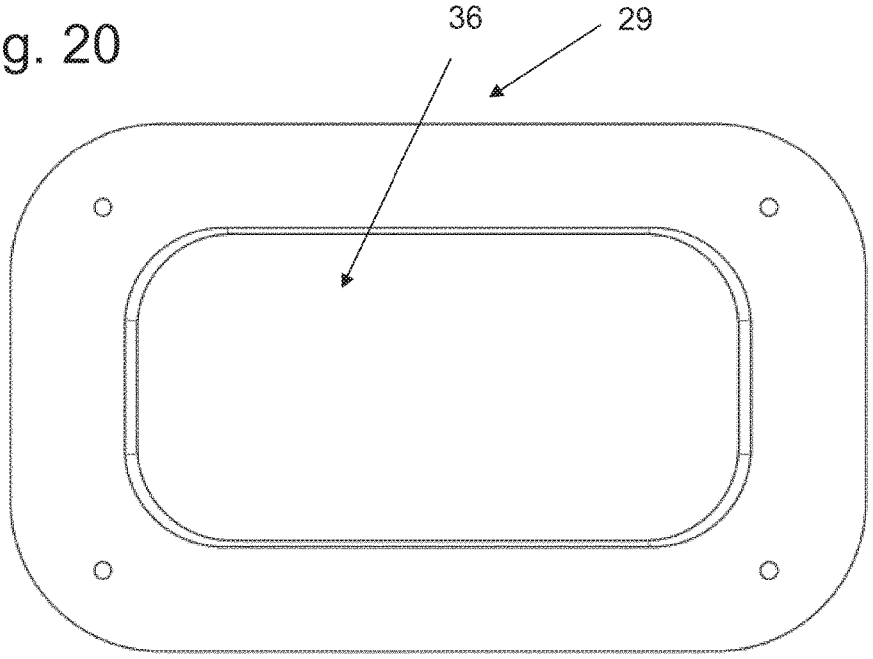
Figure 21:
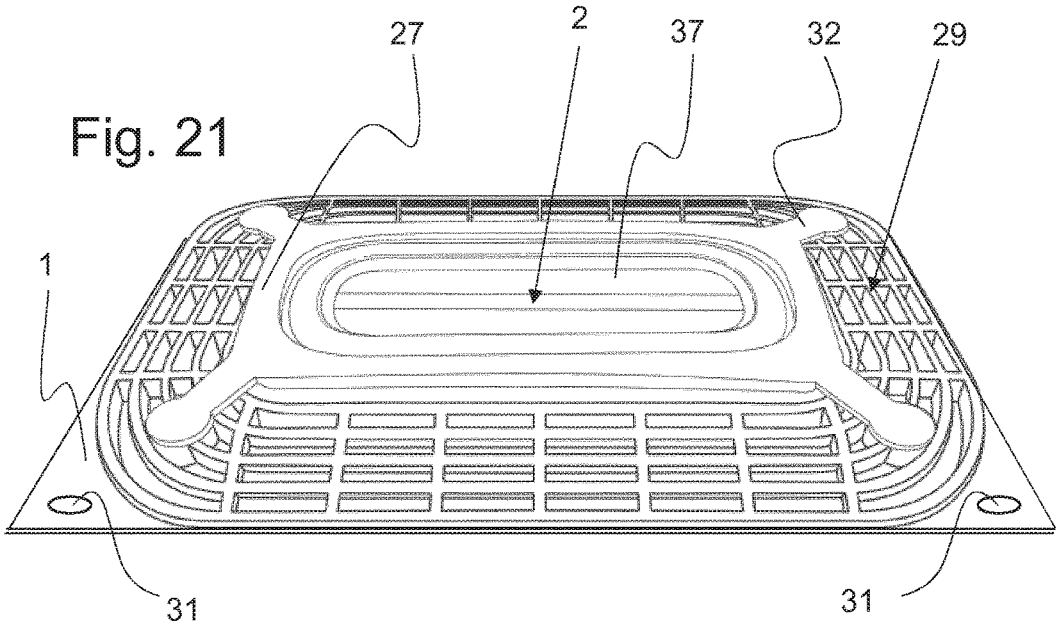
Figure 22:
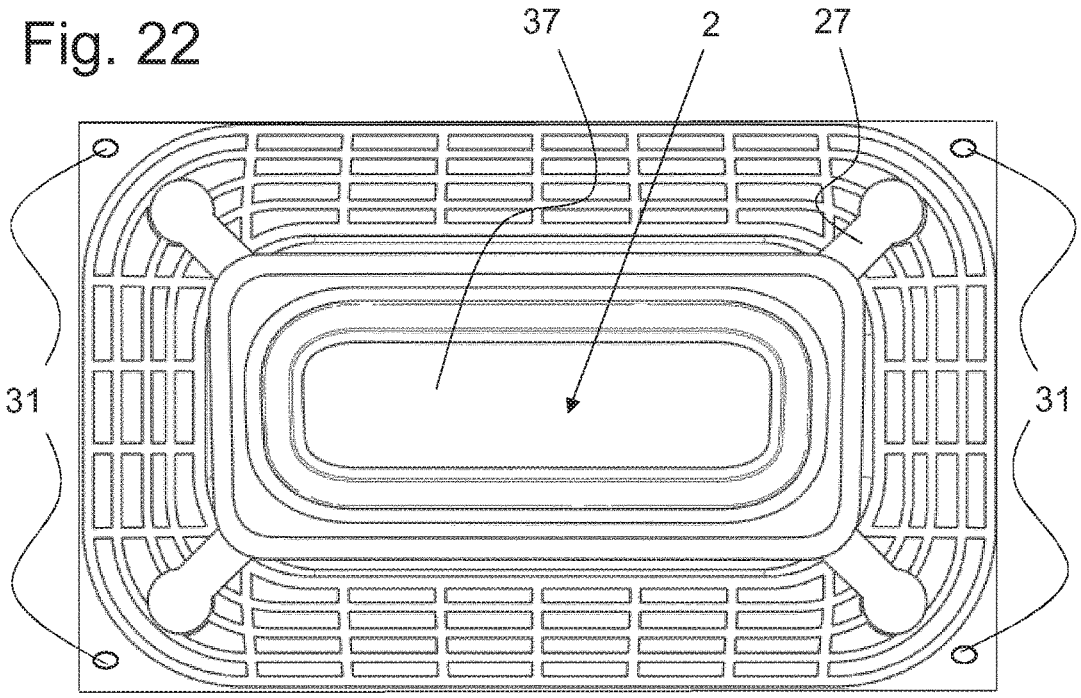

Details of the disclosure can be found in the following description of execution examples, drawings and patent claims. In the following, several examples of the disclosure are shown and described on the basis of these drawings. The drawings show:

FIG. 1 shows an overview drawing of a typical anti-sound module for equipping a planar element according to the disclosure;

FIG. 2 a block diagram of the electrical components provided in an anti-noise module of the planar element;

FIG. 3 an example of an anti-noise module for the planar element with several microphones and/or loudspeakers;

FIG. 4 a typical arrangement of several anti-sound modules in a planar element designed as a curtain on a window;

FIG. 5 a schematic representation of the mode of action of the anti-sound modules of a curtain in the case of noise incident from perpendicular to the curtain, shown in a view from above;

FIG. 6 a schematic representation of the mode of action of the anti-noise modules of a curtain in the case of noise incident from different directions, shown in a view from above;

FIG. 7 an example of a planar element used as a curtain for an open window;

FIG. 8 an example of a planar element as a slat curtain;

FIG. 9 a cover, looked into its inside;

FIG. 10 the lid seen from the inside in perspective;

FIG. 11 the lid seen on its rear side;

FIG. 12 a felt insert;

FIG. 13 an elastomer insert seen on its rear side;

FIG. 14 an elastomer insert seen on its front side;

FIG. 15 a loudspeaker shown in perspective view;

FIG. 16 looking back at the loudspeaker;

FIG. 17 the loudspeaker seen on its front side;

FIG. 18 a plate shown in perspective view;

FIG. 19 a top view of this plate;

FIG. 20 the plate seen from behind;

FIG. 21 the assembled module shown in a perspective view;

FIG. 22 the assembled module in a plan view of the front from which the anti-sound is radiated.

FIG. 1 schematically shows the external design of an anti-sound module 12 for installation in a planar element according to the disclosure, whether this planar element is designed as a curtain, as a standing wall, as a partition wall, as a ceiling part that can be installed in a room or as a wall part. The first version of the anti-sound module 12 comprises a circuit board as the core, which also serves as a connecting element for the individual components to generate the anti-sound, in particular for the loudspeaker. 2. Plastic elements, for example a cover 26 and a plate 29 can be produced cheaply from ABS, i.e. from acrylonitrile-butadiene-styrene copolymers. These are thermoplastic terpolymers which are, however, relatively expensive to develop. Thanks to their optimized design, these plastic elements effectively stabilize the interior circuit board and, for example, give a curtain designed as a lamella curtain the right shape. In addition, a size-optimized plastic element (e.g. a cover 26) serves as a resonance body for the loudspeaker. The plastic used was successfully subjected to a UV stress test. The anti-sound module has suspension elements 3 to which connecting elements can be attached for suspension and, if necessary, connection to other anti-sound modules. These connecting elements can also be used for power supply and/or electrical control, in particular for volume control. The loudspeaker can be fixed by means of an elastomer that can be produced cheaply and is resistant to wear. Thanks to a special design, this elastomer fixes the loudspeaker with minimal transmission of vibrations. UV stress tests proved the resistance and durability of this elastomer. A polyester felt of optimized thickness and density, in which the loudspeaker 2 is embedded, dampens the vibrations of the loudspeaker 2 so that the vibrations are not transmitted to the circuit board and the plastic elements.

At least one microphone 4 is arranged on the rear side facing away from loudspeaker 2, facing the source of the noise. Several loudspeakers 2 and/or microphones 4 can also be arranged in an anti-noise module 12. The depth of the anti-noise module 12 is primarily determined by the dimensions of the loudspeaker or loudspeakers 2—if several are used. Exemplary dimensions of an anti-noise module 12 with a loudspeaker 2 are 150×100 mm, with a depth of 30-50 mm or less. As such loudspeakers 2 are suitable cheap, such ones that are small and flat, with good performance, especially at lower frequencies, and with for example a nominal power handling of 4 W and a nominal impedance of 8 Ohms, which however have relatively large deviations of phase and amplitude over the frequency curve. These deviations were compensated by filters in a complex and innovative way in the course of the development. With the exception of four soldering processes for the power supply of the individual loudspeakers 2, the anti-sound module 12 can either be assembled loosely or its components can be glued together with inelastic superglue. All components are optimally matched to each other in order to achieve the necessary effectiveness. The individual Anti Noise Components ANC or Anti Noise Units 12 can be connected to each other by current-conducting, relatively stable and, above all, load-bearing copper strips. This is done exclusively by punching processes to adapt the copper strips, for example with two to four per board. The individual anti-noise modules are thus connected with thin copper strips, the ends of which can be firmly connected to the anti-noise modules by punching, and then these copper strips act on the one hand as fastening strips and on the other hand simultaneously as electrical supply wires.

In a first version of the anti-noise module 12 for the planar element, a volume control via remote control by radio or cable is provided. In another version of the anti-sound module 12, the volume, i.e. practically the amplification of the microphone signal, is fixed during production. A circuit board 1 contains an electrical circuit, which is described below.

FIG. 2 shows the block diagram of this electrical circuit for the anti-noise modules, which can be integrated into a planar element. This circuit is equipped with low-cost surface-mounted devices, i.e. SMD components, including a microphone. Microphone 4, for example a unidirectional audio microphone such as the AUM-5047L-3-LW100-R from PUI Audio, 3541 Stop Eight Rd. in Dayton, Ohio 45414, USA, feeds a preamplifier 6 which is connected to an output stage 9 via a filter/adjustment circuit 7 and a volume control 8. The latter delivers the phase-shifted output signal, adjusted to the noise level, to loudspeaker 2, which was already shown in FIG. 1. The electrical circuit can—completely or partially—be an integrated circuit (IC) on a circuit board 1 or can be made up of commercially available electronic components. Only (or with a few exceptions) low-cost SMD components including microphones are being used. In one variant, the anti-noise module 12 can consist solely of a suitably shaped circuit board 1, which is equipped with the various SMD components, i.e. also serves as a holder for the loudspeaker 2 in order to save costs and weight. This version does not actually require a closed cabinet, but a cover 26 and a plate 29 for accommodating the individual components or parts.

As mentioned in the description of FIG. 1 above, the microphone 4 is arranged on the side of the anti-sound module 12 opposite the loudspeaker 2. The use of a directional microphone or a microphone with a relatively narrow polar pattern is recommended in order to exclude or minimize acoustic feedback with the loudspeaker 2 accommodated in the same anti-sonic module 12. Despite the phase rotation of the acoustic output signal, i.e. the anti-sound, this possible feedback must be avoided because of the relatively wide frequency band used, usually up to 2000 Hz.

The filter/adjustment circuit 7 preferably contains a low-pass filter with an upper cut-off frequency of e.g. fg=2 kHz, as well as further filters which compensate the phase and amplitude characteristics of the amplification circuit and in particular the phase and amplitude characteristics of the loudspeaker(s) 2. This generates the required phase rotation of—ideally—180 degrees. Tests have shown that with a phase rotation of around 180 degrees at 703.2 Hz, a maximum noise reduction of up to 20 dB can be achieved.

The volume control 8 regulates the volume preferably non-linearly with the help of the external power supply, i.e. by means of the power supply circuit 10. A minimum current consumption is aimed at, since a multitude of anti-noise modules 12, for example 50 anti-noise modules 12 in a planar element, may have to be supplied. As mentioned in connection with FIG. 1, however, a manual or preset volume control can also be used.

In the example, power stage 9 is designed for approx. 4 W. An 8 ohm loudspeaker 2 is operated with this power as an example, e.g. type SC 4.9 FL from VISATON GmbH & Co. KG, Ohligser Str. 29-31, D-42781 Haan, Germany. This 4 W loudspeaker is characterized by a small size with external dimensions of 90 mm×40 mm and, above all, a basic depth of only 14 mm, with which a rather flat, lightweight anti-sound module 12 can be realized. Of course, similar loudspeakers can be used, possibly even more compact ones. In total, a complete single anti-sound module 12 of this type weighs less than 200 grams, i.e. only 150 grams. This low weight makes it possible to integrate the anti-noise modules 12 in a large number into a textile curtain, a lamella curtain or other planar elements.

The anti-noise modules 12 of the planar element are supplied with low-voltage power via two electrical supply wires with a single volume control for the entire installation, either via an external connection not shown here, or a battery or accumulator is provided in the anti-noise module 12, and the low-voltage power is drawn from a battery or accumulator. An external connection can also be provided if a wired volume control is being used.

FIG. 3 shows another version of a single anti-noise module 12 for a curtain as a planar element. In this design, two microphones 4 and 4' are arranged in the anti-noise module 12 in addition to loudspeaker 2 and circuit board 1, with the microphones facing loudspeaker 2 as shown in FIG. 1. This allows the electrical circuit on circuit board 1 to transmit a more balanced signal to loudspeaker 2 to produce the anti-sound. The distance between the microphone and the loudspeaker results in a phase shift between the location of the microphone and the loudspeaker when the sound falls in obliquely from above or below. This phase shift can be compensated for by suitable connection of two microphones 4, 4' with the same distance to loudspeaker 2. Alternatively, combinations of four microphones and one loudspeaker are possible, or of two microphones with two loudspeakers. Other combinations are also possible.

FIG. 4 shows a typical arrangement of the anti-noise modules 12 in a curtain as a planar element 24, suitable for equipping a double-wing, fully open window 13 or a corresponding opening. In the interior, five rows of five vertically connected anti-sonic modules 12 are integrated in the curtain and arranged essentially centrally within window 13. The loudspeakers 2 generating the anti-sound are shown schematically. The anti-noise modules 12 are suspended or connected to each other as simultaneous supply lines on wires 11, which are barely noticeable. Depending on the design of the anti-noise modules 12—as described above—these wires 11 also serve for switching on and off, for control/regulation, in particular volume control and/or for power supply of the anti-noise modules 12. Number and arrangement of the anti-noise modules 12, shown here in a 5×5 grid, are of course free and are selected in such a way that the desired degree of noise cancellation or noise reduction is achieved over the desired frequency range. Thus it is quite possible to arrange a corresponding number of anti-noise modules 12 only at the edge of a window sash, as shown in FIG. 7 and according to the corresponding description, for example in order to save costs and not unnecessarily obstruct the view through the window, even if the desired noise cancellation or noise reduction is achieved in this way.

FIGS. 5 and 6 schematically show the mode of action for different directions and properties (e.g. static versus dynamic) of the incident noise. The invented planar element 24 as sound insulation arrangement, here in the form of a curtain with self-sufficient anti-noise modules 12, makes it possible to "simulate" the dynamics of the noise to be corrected, for example the noise of a passing car, and to achieve suitable compensation.

FIG. 5 shows a vertical incident sound 14 with direction 17 of incidence, which penetrates through a window or an opening. The boundary walls 13 of the window are shown, and at their edges the incident sound is partially diffracted, according to which it is diffracted noise 15. The anti-noise modules 12 of the planar element 24 generate an even anti-noise 16, which is superimposed with a 180 degree phase shift on the incident noise 15 and thus achieves the desired noise reduction.

FIG. 6 shows an incident sound 14' from the outside with an incident direction 17', which penetrates at oblique angle through the window or an opening. The opening is again represented by the boundary walls 13. In the interior the noise occurs with diffracted noise waves 15'. The anti-noise modules 12 generate an anti-noise 16' adapted to the spatial dynamics, which is superimposed with 180 degree phase shift on the noise waves 15' and thus achieves the desired noise reduction. Due to the distribution of the anti-noise modules 12 in the planar element 24, the phase difference of the incident noise waves—for example between the left and right edge of the window or the opening—is taken into account when generating the anti-noise.

As mentioned above, a single anti-noise module 12 is approximately 150 mm×100 mm in size, with a depth or thickness of 30-75 mm or less. The horizontal and/or vertical arrangement should include an anti-noise module 12 approximately every 100 mm to 200 mm. This depends essentially on the overall arrangement of the anti-sound modules 12 in the planar element 24—which also depends on the frequency range to be compensated—for example in a curtain. In a lamella curtain, as shown and described below, such an arrangement is provided, for example.

FIG. 7 shows an example of an application for a tilted, i.e. not fully opened, window 18, for a door or a passageway between two rooms, which, for example, is provided with a sound-insulating curtain as a planar element 24. Since the background noise enters the interior to be protected primarily through openings, thanks to the modular structure these can be covered specifically with the ingenious planar element 24 in the form of a curtain and thus the noise can be reduced effectively and cost-effectively, i.e. with fewer anti-noise modules 12. In the case of window 18 shown in FIG. 7, which is only tilted and therefore not fully opened, only those areas which are directly in front of the openings need to be fitted with anti-noise modules 12. The upside-down U formation of the anti-noise modules 12 meets this requirement. Of course, the anti-noise arrangement must leave sufficient space for people to pass through a door or passageway.

It is advantageous to connect the anti-noise modules 12 inside the planar element 24 or curtain by means of a suspension which ensures mechanical stability as well as power supply and, if necessary, volume control. In most cases it will be advantageous to make this suspension flexible overall, for example by using cables or wires as connecting elements. For design reasons, the anti-noise modules 12 can be made up as dummies or combined with a specific type of curtain or integrated into a special curtain, for example into a lamella curtain.

FIG. 8 shows an example of such a lamella curtain. In a fabric or fabric web 25, a number of anti-sound modules 20 corresponding to the length of the web 25 is permanently arranged, for example sewn or glued into elongated pockets, possibly supplemented by an additional shaping plastic or light metal frame. This path or web 25 with the anti-sound modules 20 forms a lamella 19, as they are similarly used in vertical lamella curtains. In the example shown, the anti-noise modules 20 have a lenticular or oval cross-section. The anti-noise modules 20 are electrically connected in parallel to each other via wire 21 for power supply and/or volume control. The upper suspension 22 is designed as a supply line next to the mechanical fastening so that the power supply and/or the control can be transmitted electrically. The curtain rail 23 is also designed in such a way that, in addition to the sliding and rotating slats, the power supply and/or control is also possible. Both are only indicated in FIG. 8, as is a second lamella 19', which can also be equipped with anti-noise modules. Of course, module slats can also be arranged alternately with slats without anti-noise modules, which together form the planar element, or any combination of module slats and slats without anti-noise modules can be formed, depending on the desired capacity of the noise compensation. Here again the simple installation of the inventive planar element or curtain as anti-noise arrangement is shown, which is also possible to install by non-specialists, whereby the desired noise compensation can be adjusted once during installation by simple trial and error and can be improved at any time easily and with little effort if the noise conditions change.

Instead of a lamella curtain equipped with anti-noise modules, mobile partitions with anti-noise modules can also be realized as planar elements according to the disclosure and used in a similar way. This would be useful, for example, if there are noisy machines in an open-plan office whose background noise is to be compensated. Such planar elements designed as partitions have a similar structure to the previously shown curtain design examples and are therefore not explicitly shown. Mobile partition walls as planar elements, which contain the anti-noise modules hidden at an optimised distance from each other, make it possible in a flexible way to protect certain parts of the room against noise, to ensure privacy and/or to contain sound reflections.

The same applies to a flat ceiling part or ceiling element or a flat wall part or wall element as a planar element with integrated anti-noise modules, with which, for example, background noise from a floor above the room in question or from an adjacent room can be compensated. Such single or several ceiling or wall elements are used for this purpose.

The anti-noise modules can also be integrated into blinds or shutters, which then become planar elements with anti-noise function. Such implementations will not cause any difficulties for the expert.

In the following figures not only a schematic representation of the individual components of such a planar element is shown, but an example of an actual conversion of the planar element with its anti-sound modules and the components for it and how these components look or can look like. It is clear that the structure of the planar element as well as of the individual anti-sound modules can be varied, and in particular also their dimensioning. However, the structure of the planar element presented here proves to be functional and suitable for practical use. First, FIG. 9 shows a cover 26 for a single anti-sound module, seen from the inside. One can see here a grid-like rib structure 5 to reinforce the rear wall. This cover 26 is intended to cover the back of the loudspeaker. In FIG. 10 the cover 26 is shown in a perspective view of the inside of the rear wall, and in FIG. 11 it is shown with a view of the outside of the rear wall. It is an injection-moulded plastic part.

Another mounting part is a felt insert 28 with recess 34 as shown in FIG. 12, which serves to damp the loudspeaker vibrations. Another component of the anti-noise module 12 is a soft elastomer insert 27 as shown in FIG. 13, where it can be seen on its back. The inner area 33 forms a recess, thus a free passage, and at the four corners arms 32 protrude over the edge and these are interspersed with pins 30 made of plastic or metal. FIG. 14 shows the smooth front of this elastomer insert 27.

FIG. 15 shows the loudspeaker 2 in perspective as it is suitable for installation in this anti-sound module. It is a particularly light and flat loudspeaker 2, measuring for example 150 mm×100 mm, with a depth of 30 mm to 75 mm or less, and with a rated power handling of 4 W and a rated impedance of 8 Ohms. FIG. 16 shows this loudspeaker 2 seen on its rear side. Here one can see the electrical part 38 of loudspeaker 2, and FIG. 17 shows its front side. The speaker diaphragm 37 is held and mounted by a soft, circumferential rubber lip 35. Furthermore, FIG. 18 shows a grid-like plate 29 in perspective view, with a central recess 36 and FIG. 19 in plan view, and FIG. 20 shows it seen from the other side.

All these parts mentioned and shown above are assembled into a single anti-sound module 12, as shown in FIG. 21 and FIG. 22. First the felt insert 13 is put over the speaker 2 from behind, so that the electrical part 38 of the speaker 2 comes to rest in the recess 34 at the felt insert 28. This felt insert 28 serves to dampen the vibrations of loudspeaker 2 on its rear side. Then the plate 29 with recess 36 is laid over the front side of the loudspeaker and then the elastomer insert 27 is attached to its arms 32 of the plate 29 by means of its pins 30. The loudspeaker 2 with plate 29 is placed with its front side facing upwards, from which the sound is radiated, i.e. with the loudspeaker diaphragm 37 visible in FIGS. 21 and 22, on the recess provided for it on circuit board 1, so that its loudspeaker diaphragm 37 lies above the congruent recess on circuit board 1. The loudspeaker 2 is then covered from behind with the cover 26, whereby this cover 26 (as well as the plate 29 on the opposite side of the circuit board 1) is glued to the circuit board 1. The various switching elements are then located outside the cover on the circuit board 1. An entire chain can be formed from such anti-sound modules 12 by connecting them to the fastening elements 31. A number of such chains arranged side by side finally form a planar element after the disclosure and this can, for example, be integrated into a curtain made of fabric or other materials or the planar element forms a curtain.

Since the operation of such a single anti-noise module or an entire anti-noise arrangement consisting of several anti-noise modules 12 in the form of a planar element can be limited to the time during which persons are present in the room to be protected from the noise, switched operation definitely makes sense and is useful. The anti-noise arrangement can be switched on and off by one or more motion detectors in an anti-noise module or externally. A time switch is also possible, although this is not explicitly shown in the figures. Such motion detectors or time switches are usually used for automatic light activation and light deactivation. The expert does not have much trouble to implement the concept of a planar element with anti-sonic modules other than explicitly described here.

The present disclosure therefore shows a relatively simple solution which can be installed indoors with comparatively little effort, especially retrospectively, and which can be adapted to the specific noise situation.

INDEX OF NUMBERS

1 Circuit board
2 Loudspeakers
3 Mounting element/supply line
4 Microphone
5 Grid-like rib structure
6 Preamplifier
7 Filter/adjustment circuit
8 Volume control
9 Output stage
10 Power supply circuit
11 Wire, supply line
12 Anti-noise module
13 Boundary wall window
14, 14' Noise in FIG. 5 or 6
15, 15' Diffracted noise in FIG. 5 or 6
16, 16' Anti-noise in FIGS. 5 and 6, respectively
17, 17' Direction of incidence of background noise in FIGS. 5 and 6 respectively
18 Open window
19 Blade
20 Anti-sonic module in cable 21
21 Cable with anti-noise modules 20
22 Suspension, supply line
23 Curtain rail
24 Planar element in FIGS. 5, 6 and 7
25 Planar element in FIG. 8
26 Cover
27 Elastomer insert
28 Felt insert
29 Plate
30 Pins
31 Mounting element for connecting and supplying individual anti-noise modules
32 Arms on elastomer insert 27
33 Recess on elastomer insert
34 Recess on felt insert
35 Rubber lip as loudspeaker membrane holder
36 Recess on the plate
37 Loudspeaker membrane
38 Electrical part of loudspeaker 2

The invention claimed is:

1. A planar element, designed as a curtain for a window, as a standing wall or partition wall, as a ceiling part, or as a wall part for active compensation of background noise in an interior space, the planar element comprising: a plurality of identical anti-noise modules which are connected to one another and each have at least one microphone, an associated electronic circuit having a combination of filters for adapting phase and amplitude and in each case one associated central electronically controllable amplifier or amplifier assigned to the anti-sound module and in each case one associated loudspeaker, wherein the planar element has over its width on a plurality of different lines in each case a plurality of anti-sound modules which can be controlled analogously, which measure from 14 mm to 75 mm in thickness, from 90 mm to 200 mm in length, and from 40 mm to 200 mm in width, having a weight of from 50 grams to 300 grams per anti-sound module, so that they are integrated into the planar element and each together form each a chain of anti-sound modules extending along these lines, which are arranged in succession via electrical supply wires connecting them together in the form of two electrical wires each extending along this line, the chain being connected in parallel with its supply wires and being supplied with a low-voltage power by two electrical supply wires or supply rails which run transversely to the wires of the chains.

2. The planar element according to claim 1, designed as a curtain for a window, wherein the curtain comprises over its width, on several different falling lines, in each case a plurality of analogue controllable anti-sound modules which are integrated into the curtain and together in each case form a falling hanging chain of anti-sound modules, the electrical supply wires which connect them together are arranged suspended from one another in the form of in each case only two electrical wires running along the falling line, the chain being arranged with its supply wires connected in parallel by two electrical supply wires or supply rails under a low-voltage power, and which run transversely to the falling lines of the falling chains.

3. The planar element according to claim 1, designed as a standing wall or a partition wall, wherein a plurality of parallel lines, each having a plurality of analogue controllable anti-noise modules, are integrated into the standing or partition wall distributed over its width or height, so that they are integrated into the standing or partition wall and together each form a chain of anti-noise modules, which are arranged connected to one another via electrical supply wires connecting them together in the form of in each case only two electrical wires extending along the line of the chain, the chain being connected with its supply wires in parallel to two electrical supply wires or supply rails under a low-voltage power and which run transversely to the lines of the chains.

4. The planar element according to claim 1, designed as a ceiling element, wherein a plurality of parallel lines, each having a plurality of analogue controllable anti-noise modules, are integrated into the ceiling element distributed over its width or length or height, so that they are integrated into the ceiling element and each together form a chain of anti-noise modules, which are arranged connected to one another via electrical supply wires connecting them together in the form of in each case only two electrical wires extending along the line of the chain, the chain being connected with its supply wires in parallel to two electrical supply wires or supply rails under a low-voltage power which run transversely to the lines of the chains.

5. The planar element according to claim 1, wherein the amplifiers of the anti-sound modules have an output of up to 4 W and the loudspeakers have a load capacity of 4 W with an impedance of 8 Ω, external dimensions of 100 mm×50 mm and a maximum installation depth of 20 mm.

6. The planar element according to claim 1, wherein the amplifiers of the anti-sound modules have an output of up to 4 W and the loudspeakers have a load capacity of 4 W with an impedance of 8 Ω, external dimensions of 100 mm×50 mm and a maximum installation depth of 20 mm.

7. The planar element according to claim 1, wherein the amplifiers of the anti-sound modules have an output of up to 4 W and the loudspeakers have a load capacity of 4 W with an impedance of 8 Ω, external dimensions of 100 mm×50 mm and a maximum installation depth of 20 mm.

8. The planar element designed as a curtain for a window or as a standing or partition wall according to claim 1, wherein the microphones of each anti-sound module on the curtain or the standing or partition wall are aligned with their sensitive side towards one side of the curtain, so that the curtain or partition can be suspended or erected with these sensitive sides of the microphones directed towards one side, while the loudspeakers are then directed with the sound emitted by them towards the other side of the curtain away from it, for sounding an interior space.

9. The planar element designed as a curtain for a window or as a standing or partition wall according to claim 1, wherein the microphones of each anti-sound module on the curtain or the standing or partition wall are aligned with their sensitive side towards one side of the curtain, so that the curtain or partition can be suspended or erected with these sensitive sides of the microphones directed towards one side, while the loudspeakers are then directed with the sound emitted by them towards the other side of the curtain away from it, for sounding an interior space.

10. The planar element according to claim 1, designed as a curtain for a window, as a standing or partition wall, or as a ceiling part, wherein the anti-sound modules each have an electronic circuit which is designed wholly or partly as an integrated circuit according to a block diagram, which includes a unidirectional audio microphone, a preamplifier in each case, which is connected to an output stage via a filter/adjustment circuit and a volume control in each case, for generating and outputting electrical signals of the loudspeaker which are phase-shifted by 180° in comparison with the electrical signals generated by the microphone.

11. The planar element according to claim 1, designed as a curtain for a window, as a standing or partition wall or ceiling part, characterized in that the anti-sound modules have an electronic circuit which is designed wholly or partly as an integrated circuit and includes a low-pass filter with an upper cut-off frequency of 2 kHz, and further filters which compensate for the phase and amplitude characteristic of the amplification circuit and of the loudspeaker or loudspeakers.

12. The planar element according to claim 1, wherein the individual anti-sound modules have a circuit board and plastic elements which comprise the loudspeaker, the electronic circuit and at least two microphones which are spaced apart from one another and from the loudspeaker and being possible for the circuit to compensate for the phase shift of the signals of the microphones at different directions of the incoming sound, and after which these compensated signals can be delivered to the loudspeaker with 180° rotated phase.

13. The planar element according to claim 1, wherein the individual anti-sound modules have a circuit board and plastic elements which comprise the loudspeaker, the electronic circuit and at least two microphones which are spaced apart from one another and from the loudspeaker and being possible for the circuit to compensate for the phase shift of the signals of the microphones at different directions of the incoming sound, and after which these compensated signals can be delivered to the loudspeaker with 180° rotated phase.

14. An anti-noise module for installation in the planar element according to claim 1 for active compensation of background noise in an interior space by noise compensation, wherein this anti-noise module has stabilizing, protective plastic elements which also optimize the anti-noise, and at least one microphone aligned on one side of the circuit board and at least one loudspeaker aligned in the opposite direction are fitted, and at least one preamplifier connected to an output stage connected to the loudspeaker via a filter/adjustment circuit and a volume control, and connected for parallel connection to two electrical conductors, and in that this anti-sound module is up to 50 mm thick, up to 150 mm long and up to 100 mm wide and has a maximum weight of 200 grams.

15. An anti-noise module for installation in the planar element according to claim 1 for active compensation of background noise in an interior space by noise compensation, wherein the electrical circuit of the anti-noise module is a completely or partially integrated circuit, equipped with SMD components including a unidirectional audio microphone, and in that the loudspeaker is positioned with its loudspeaker diaphragm in the recess of a plate glued onto the front side of the circuit board and an elastomer insert with plug-in pins is plugged and glued onto the plate, while a felt insert is placed on the rear side of the loudspeaker and over its electrical part, and then a cover with a rib-reinforced rear wall is glued over the rear side of the loudspeaker onto the circuit board, which cover is intended to act as a resonance body for the inside loudspeaker, and in that the anti-noise module, together with the circuit board, plate and cover, is up to 50 mm thick overall and up to 150 mm long and up to 100 mm wide, having a maximum weight of 200 grams, having a flat loudspeaker with 4 W rated power, 8 Ohms rated impedance, and 120 to 20,000 Hz frequency range.

* * * * *